US012782089B2

(12) United States Patent
Jiang

(10) Patent No.: US 12,782,089 B2
(45) Date of Patent: Nov. 3, 2026

(54) FIREARM SIMULATION DEVICE WITH HAPTIC FEEDBACK

(71) Applicant: Chunyang Jiang, Bradenton, FL (US)

(72) Inventor: Chunyang Jiang, Bradenton, FL (US)

( * ) Notice: Subject to any disclaimer, the term of this patent is extended or adjusted under 35 U.S.C. 154(b) by 188 days.

(21) Appl. No.: 18/420,923

(22) Filed: Jan. 24, 2024

(65) Prior Publication Data

US 2025/0189271 A1 Jun. 12, 2025

Related U.S. Application Data

(63) Continuation-in-part of application No. 18/469,550, filed on Sep. 18, 2023, and a continuation-in-part of application No. 18/454,871, filed on Aug. 24, 2023, and a continuation-in-part of application No. 18/479,089, filed on Oct. 1, 2023, now abandoned, and a continuation-in-part of application No. 18/484,551, filed on Oct. 11, 2023, and a continuation-in-part of application No. 18/395,584, filed on Dec. 24, 2023, now abandoned.

(51) Int. Cl.

| | |
|---|---|
| ***F41G 3/30*** | (2006.01) |
| ***F41A 19/01*** | (2006.01) |
| ***F41G 3/26*** | (2006.01) |
| ***F41G 3/28*** | (2006.01) |

(52) U.S. Cl.

CPC ..... *F41G 3/30* (2013.01); *F41A 19/01* (2013.01); *F41G 3/2688* (2013.01); *F41G 3/28* (2013.01)

(58) Field of Classification Search

CPC ..... F41G 3/28; F41G 3/30; F41G 3/26; F41G 3/2688; F41A 19/01

See application file for complete search history.

(56) References Cited

U.S. PATENT DOCUMENTS

| | | | | |
|---|---|---|---|---|
| 8,164,461 | B2 * | 4/2012 | Bischoff | H04Q 9/00 434/258 |
| 2008/0131848 | A1 * | 6/2008 | Wilson | F41A 9/61 434/24 |
| 2016/0158604 | A1 * | 6/2016 | Balakrishnan | A61B 5/0002 434/247 |
| 2017/0046975 | A1 * | 2/2017 | Becker | B23K 9/287 |
| 2019/0154401 | A1 * | 5/2019 | Almagor | G06V 40/23 |
| 2019/0281259 | A1 * | 9/2019 | Palazzolo | H04N 7/183 |

* cited by examiner

*Primary Examiner* — Timothy A Musselman
(74) *Attorney, Agent, or Firm* — Robert Brownstein

(57) ABSTRACT

There is a need in the firearm training field for a firearm that can analyze the shooter's grip, aim, position, and anything else that could affect a shooter's technique. The invention is designed to monitor the shooter's technique in real-time using motion sensors to determine any movement by the firearm or the shooter. A light based detection system also tracks the shooter's and firearm's movement by detecting the amount of time it takes for light emitted from the device to reflect back to the device. The motion detected is analyzed and converted into a haptic feedback for the device to emit to the user, usually in the form of a vibration or shaking. The shooter can interpret the haptic feedback in real-time and correct their shooting technique without having to interrupt their shooting session.

20 Claims, 9 Drawing Sheets

Logo|3"|FIXED 3|5S/PT5S|Indoor|12:45PM|3/15/2022|GEAR ICONS***

Today 's Session #001

1st Shot 0.00|Split time 0.00

START

Shot # 0|Rounds Per Minute 0

00.00 TOTAL TIME

PAUSE/RESUME|STOP

701

| | | |
|---|---|---|
| Session name | ABCDE | 00125 |
| Date | 1/15/2023 | 1/17/2023 |
| Total Time | 6.72 | 5.72 |
| Total Shots | 15 | 23 |
| Deatils | 2. | 2. |
| Per Timer | 2. | |
| | ⊖ | ⊖ |

702

Figure 7

FIREARM SIMULATION DEVICE WITH HAPTIC FEEDBACK

BACKGROUND

Firearms are used for personal protection, sports like hunting, recreational like competitive shooting, as well as law enforcement and military applications. But with firearm use comes the need for people to be trained for using their firearms. Firearm training in this country, especially in the area of law enforcement firearm training, has evolved over the years, from something as simple as target practice, to intense real-time scenarios that try to mimic real life situations.

The forensic science discipline of firearms and tool work analysis dates back to the early 1900s. Traditional methods primarily rely upon a trained and experienced firearms examiner using a comparison microscope to assess similarities of known and unknown items to generate conclusions. Firearm safety training courses are available in levels for all shooting skill levels and can cover a wide range of topics, including proper firearm handling, cleaning, maintenance and repair, accuracy and proper shooting techniques, and finally local and national laws applying to firearms. Some courses provide live-fire demonstrations to educate shooters on shooting proficiency and safe use of the firearms. Despite the advancements in the area, there are significant limitations in the current training methods, particularly in educating shooters to adapt to real-world scenarios which would help shooters learn and maintain a level of muscle memory when shooting a firearm.

The current real-world condition simulations used in law enforcement are currently lacking in areas such as close quarter tactics, engagement with multiple and dynamic threats, and the transition from the need to brandish and/or shoot a firearm, to the arrest phase of the altercation, and finally the calming and reassurance of innocent bystanders. Another issue with current training methods is the lack of real-time feedback for the trainees, which is crucial in refining shooting techniques and improving reaction times in dynamic, unpredictable, and dangerous situations.

Firearm training also needs to focus more on physiological and psychological responses, to deal with the increased stress has on a shooter's performance and possible decreased motor function. By using randomness and unpredictability in training scenarios would allow for a shooter to understand how their body reacts in those scenarios and better adapt their shooting to those scenarios.

Variability in the quality and content of training programs can also cause problems, as shooters attending courses that do not adequately prepare them may result in shooters that lack in basic firearms techniques, but an increased sense of confidence, knowing that they attended a firearm training course. This could lead to issues with firearm safety, as knowing how to properly use and fire a firearm is the best way to protect the shooter and those around them. If the firearm safety is stressed in the training courses, proper firearm handling and storage habits can be engrained into a shooter, to improve the safety of themselves and those around them. Considering the limitations discussed above, there is a clear need for an innovative and comprehensive approach to addresses these issues.

SUMMARY OF THE INVENTION

There needs to be a training system that relies on integrated haptic feedback and utilizes accelerometers, gyroscopes, other sensors, and haptic motors to enable for a more realistic and effective training experience. The proposed invention would use these sensors to simulate real-world scenarios more accurately than current systems and also offer immediate tactile feedback based on a shooter's actions.

The invention would continually measure the movement and stability of the firearm during training exercises, and provide real-time feedback to the shooter during an exercise. Adding a sense of realism to training exercises would enhance the shooter's training by constantly challenging trainees with realistic simulations of real-world events. The feedback could be used by a shooter, or a trainer, to help them improve their muscle memory and reaction times while shooting, which would improve performance. The feedback could also be used to improve and tailor the training exercises for individual shooters.

In conclusion, the proposed system addresses the critical gaps in current firearms training methodologies, and introduces a novel approach that leverages modem sensor and haptic feedback technologies that will improve firearm training. This system has the potential to significantly enhance the effectiveness, realism, and adaptability of firearms training programs, making it a valuable innovation in the field.

BRIEF DESCRIPTION OF THE FIGURES

FIG. 7 shows a detailed view of the timing information.

DETAILED DESCRIPTION OF THE INVENTION

Figure 1:
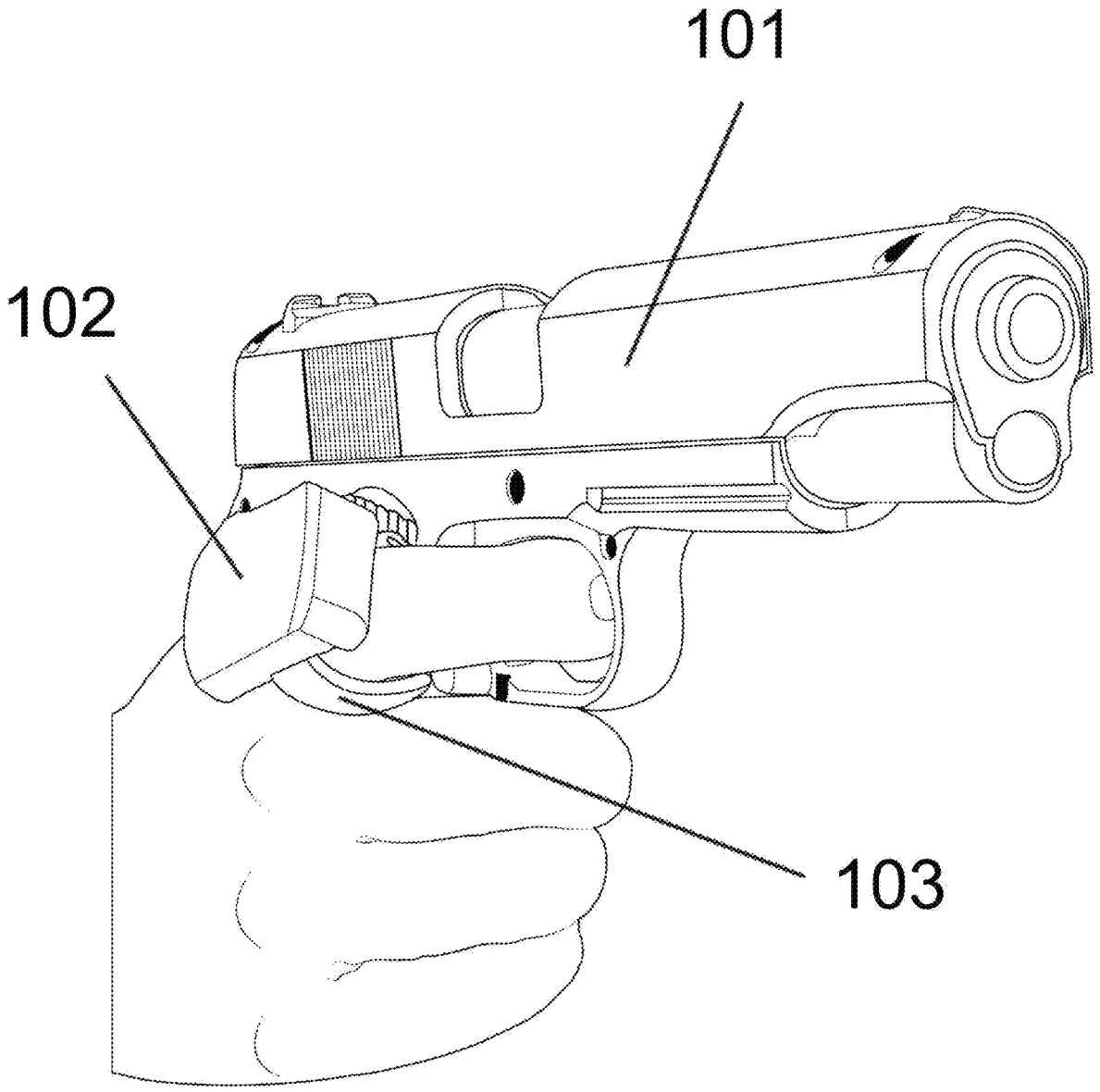
FIG. 1 shows the recoil detector attached to a user's finger.

FIG. 1 shows a haptic simulation device 101 for detecting a mock shooting of a firearm in a training or learning scenario. The device would be small enough to be used without interfering with the user's shooting methodology. The device could be mounted on a firearm itself or on a user's finger, wrist, arm, or anywhere on the user's body. When the user pulls the trigger, the device measures the motion caused by the user's hand and finger to indicate that they intend to shoot the firearm. The firearm could be unloaded, plugged, and/or having it's firing pin removed so as to protect the user and the people around them, while allowing for a real life experience.

The use of real firearms would be preferred to a mock firearm made of rubber or plastic as the goal of using the device is training on how to react to firing any firearm or even a particular firearm. The device could use an inertial measurement unit (IMU) that contains accelerometers, magnometers, gyroscopes, or any type of sensor that can perform precise changes in movement detection in six different directions. The sensor(s) would be capable of measuring motion of the firearm and/or the user in six dimensions and provide sub-millimeter motion tracking. When the device detects a trigger pull, indicating that a user is firing the firearm, the device triggers a haptic motor, servo, actuator, vibrating device, or device capable of creating a motion in any given direction. This motion simulation would simulate the recoil action of a firearm without actually firing the weapon. The IMU would also be used to track the user's movement as well as the movement of the firearm for analyzing the user's stance, grip, aim, reaction time to targets, or any other movement based metric that the system can then cause the device to vibrate or shake so as to instruct the user to correct their shooting technique.

The simulated recoil or other motion would be a default movement that is an aggregate of all firearm recoil forces, an aggregate of firearm recoil forces for a particular type of firearm, such as a rifle or piston, or the recoil forces for a specific firearm. The measurements to create the recoil forces could be measured for each firearms separately, or they could be combined via a mean or average from all like firearms being used with a network connected Recoil Detection Device being used by shooters around the country or world.

The haptic simulation device would also contain sensors that can aide in mapping the area around it and the user, which would supplement the information captured by the IMU. The mapping would be done using infrared depth mapping sensors or Time of Flight (ToF) detectors. These sensors would emit infrared light, but any wavelength of light could be used, and then use light sensors to detect the time it takes for the light to reflect or bounce off of surfaces near the device and user, which can then be used to calculate how far away the surfaces are. Multiple emitters and sensors are used, and the distances calculated are then aggregated to create a mapping of the environment. The mapping can then be compared continuously to determine where the sensor, and therefore the user and the firearm, are in the area. When combined with the motion sensors described above, the result is a precision record of how the device has and is moving in an area. The sensors could be calibrated at the beginning of a training session, or they could map the area live as the training session is completed.

When the data is collected from the various sensors in real time preferably with a frequency of every 50 ms, the device is able to detect motion of the device, and therefore the user and firearm, too subtle to be noticed by the naked eye. This information is used to analyze the user's grip strength, steadiness of the hands and firearm, the positioning of the hands and the firearm, recoil anticipation, aim, speed of aiming, shot speed, trigger pulling speed, and any other metric that could be used to coach the user after the training session or in real time as the session elapses. The device could use a speaker or could connect to a wireless speaker such as an earbud that is within earshot of the user to instruct the user how to improve. Artificial Intelligence and/or Machine Learning could be used to find patterns in the user's actions and performance and create an even more detailed coaching or training analysis. The device uses an algorithm to analyze the data collected by the sensors in real-time and then the device can generate the corrective output that is then interpreted by the user to correct their shooting technique. The speed of the sensors and algorithm provide added benefits by correcting the user's technique in real-time during a training or exercises, such as close quarter engagements, which are more stressful than traditional firearm range training, which would help improve the user's shooting technique.

In another embodiment, the haptic simulation device would be in the form of creating feedback for the user while they were handling the firearm. The feedback could be in the form of vibrating or shaking, caused by the motors and/actuators. When a user is participating in a simulation the device would inform the user that their shooting technique requires correcting. The types of corrections could include, but are not limited to, proper aim, proper grip, proper hand position, hand shaking, or any other metric that could be used to analyze a user's shooting technique. The device would monitor the user's and firearm's positions in real time using the sensors and translate the motion into usable information in the form of motion feedback so as to correct the user's shooting technique. The motion or vibration could be a static amount, or it could be dynamic based on now much correction the user requires. The vibrations could be a constant frequency or the intensity of the frequency could increase when the user requires more correction, and decrease when the user needs little or no correction. The base line of motion could be zero, as in the device would not create any motion when the user is performing perfect or near perfectly. The motion or vibration could be dynamic in that it creates different types of motion depending on the correction needed, akin to an Apple Watch having different vibrations depending on which direction the wearer needs to go. A certain motion or vibration could be used to indicate left or right motion required by the user, up or down motions, or a combination of the two. The different motions or vibrations could also be used to correct certain things, like a vibration assigned to grip while a different vibration is assigned to aim. Of course any combination of these motions and vibrations could be used, as long as they could easily be interpreted by the user to correct their shooting techniques.

FIG. 1 shows a preferred embodiment of the invention showing a person holding a pistol with their right hand, although the invention could be used on either hand. The haptic simulation device 102 would be attached to the user's finger via a strap 103, while they hold onto pistol 101. While a pistol will be shown in the figures, any type of firearm/shooting device could be used with the haptic simulation device, including but not limited to a shotgun, a rifle, a bow, a revolver, a grenade launcher, and a blow dart. The haptic device is shown as being attached to the user's finger, but the haptic device could be, but is not limited to being, attached to a user's wrist, arm, body, or the firearm itself.

The haptic device would ideally be 1.4" by 1" form factor, but any size or shape could be used as long as the device's size and shape does not interfere with the user's ability to shoot.

The device is made of a hardened plastic that allows for the device to weather the repeated firings, snow, rain, sleet, hail, wind, heat, or any other extreme conditions that the user is likely to experience. The device would be low in weight, without sacrificing the functionality of the device. Any type of material could be used as long as it is sturdy enough and can weather the elements. Also, the device could be any color, pattern or design to allow for customizations for the shooter to stand out while using the device.

The haptic device would include sensors that provide data to an onboard processor using an algorithm to detect waveforms when the user's fires a firearm while the device is attached. The algorithm uses the sensor data that includes, but isn't limited to, data from a accelerometers, gyroscopes, and magnetometers to detect shot signatures and accurately detect when a firearm trigger is pulled. The forces detected by the sensors include, but are not limited to, recoil force vectors, torque, recoil anticipation, hand twitch, or any other force or movement that could impact a shooter's performance. The shot information is preferably sent from the device to a user's phone via a Bluetooth connection, but any type of connection could be used, including but not limited to, Wifi, an adhoc network, NFC, RFID, and a wired connection. The device includes means for input that include, but is not limited to, physical buttons, switches, touch screens, and dials, for manually triggering a shot detection event and changing settings on the device.

The haptic device would process the sensor data and provide a shot detection every 50 milliseconds, which would allow for the user to fire the firearm repeatedly. The device would be preferably be powered by a lithium ion battery with voltage regulation and status monitoring performed by a combination of hardware and/or software, but could be any type of battery that is used in portable devices. The communication between the phone and the device would be encrypted and the user's identify would be authenticated on the user's phone, to ensure that the user's privacy was preserved. While a phone has been used to describe the user device that collects the data from the haptic device, any type of computing device could be paired with the haptic device, including but not limited to a tablet, computer, laptop, desktop, watch, AR glasses or head mounted display, VR glasses or head mounted display, or any device able to collect and display information to a user. In one embodiment, the hepatic device and the user device could be integrated in to a smart watch that can output information to the user, removing the requirement for multiple devices. The phone could be used to control settings of the haptic device via a user interface that is displayed via the app. The additional devices could be used by the user to review their performance after the training exercise to view a simulation of the training exercise or have a coach, teacher, Al, ML, or algorithm annotate the information provided to the user to instruct the user to specific points in the exercise where the user needs improvement.

Figure 2:
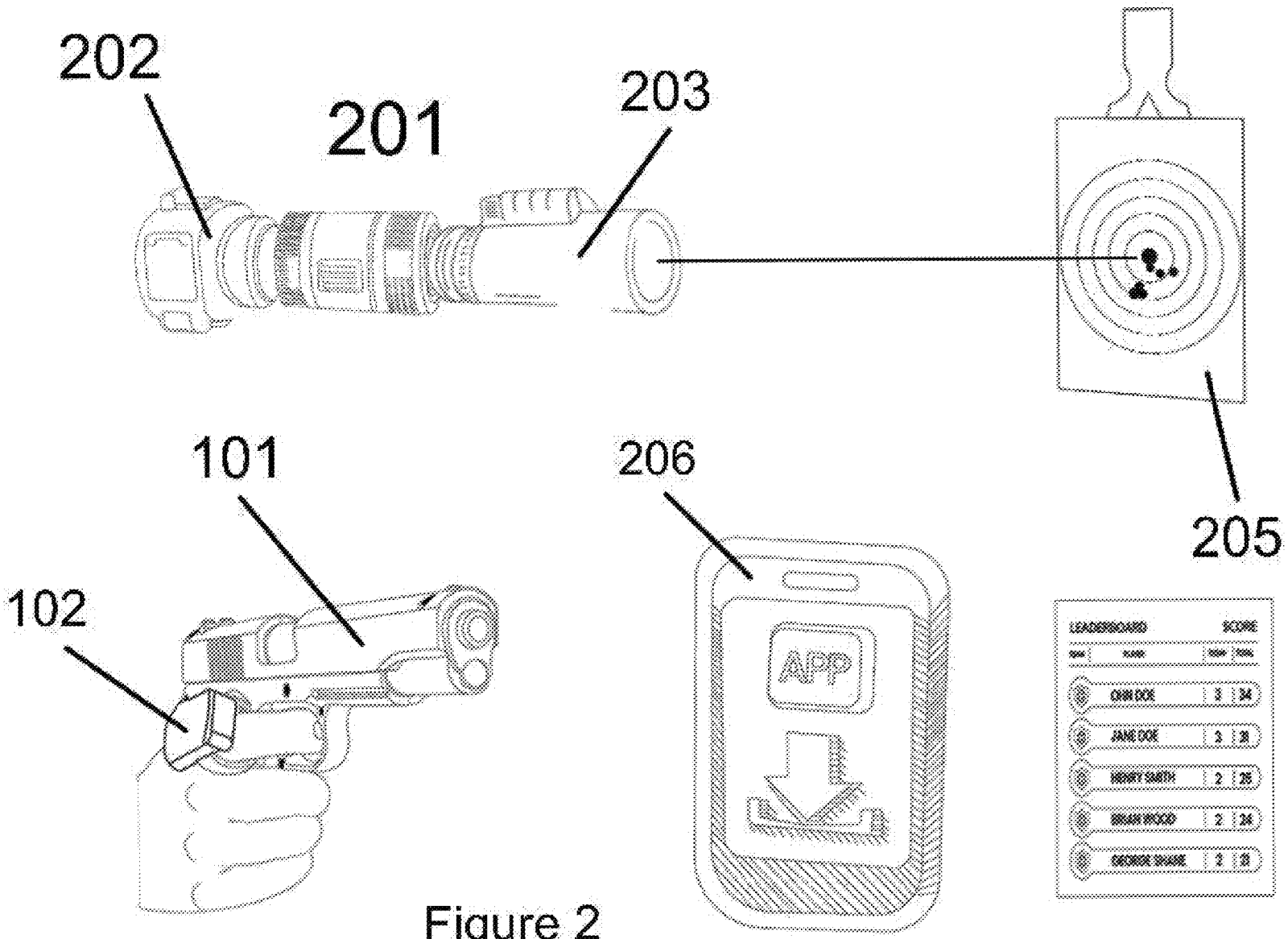
FIG. 2 shows an overall embodiment of the targeting system.
Figure 3:
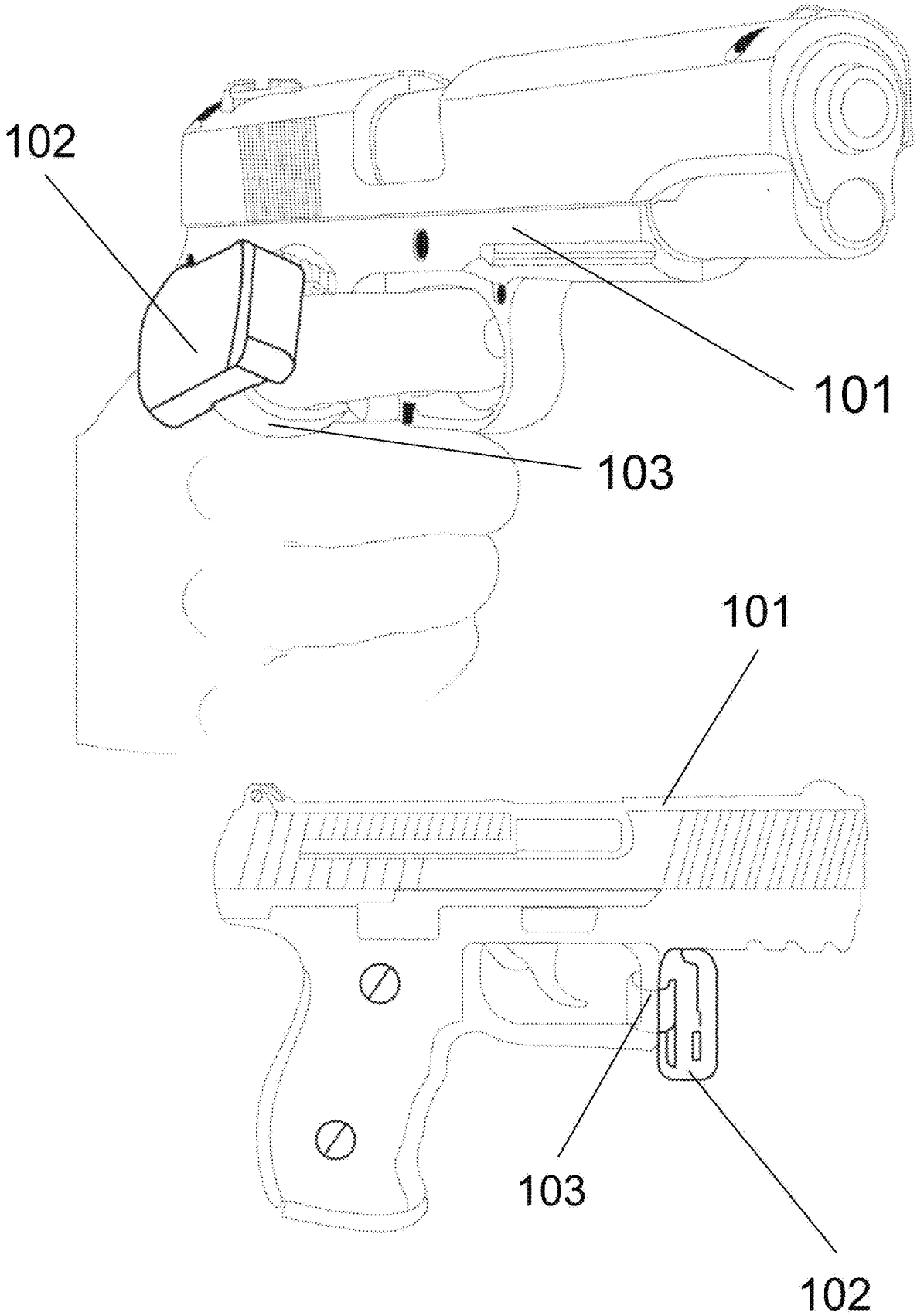
FIG. 3 shows the recoil detector mounted to a finger or firearm.
Figure 4:
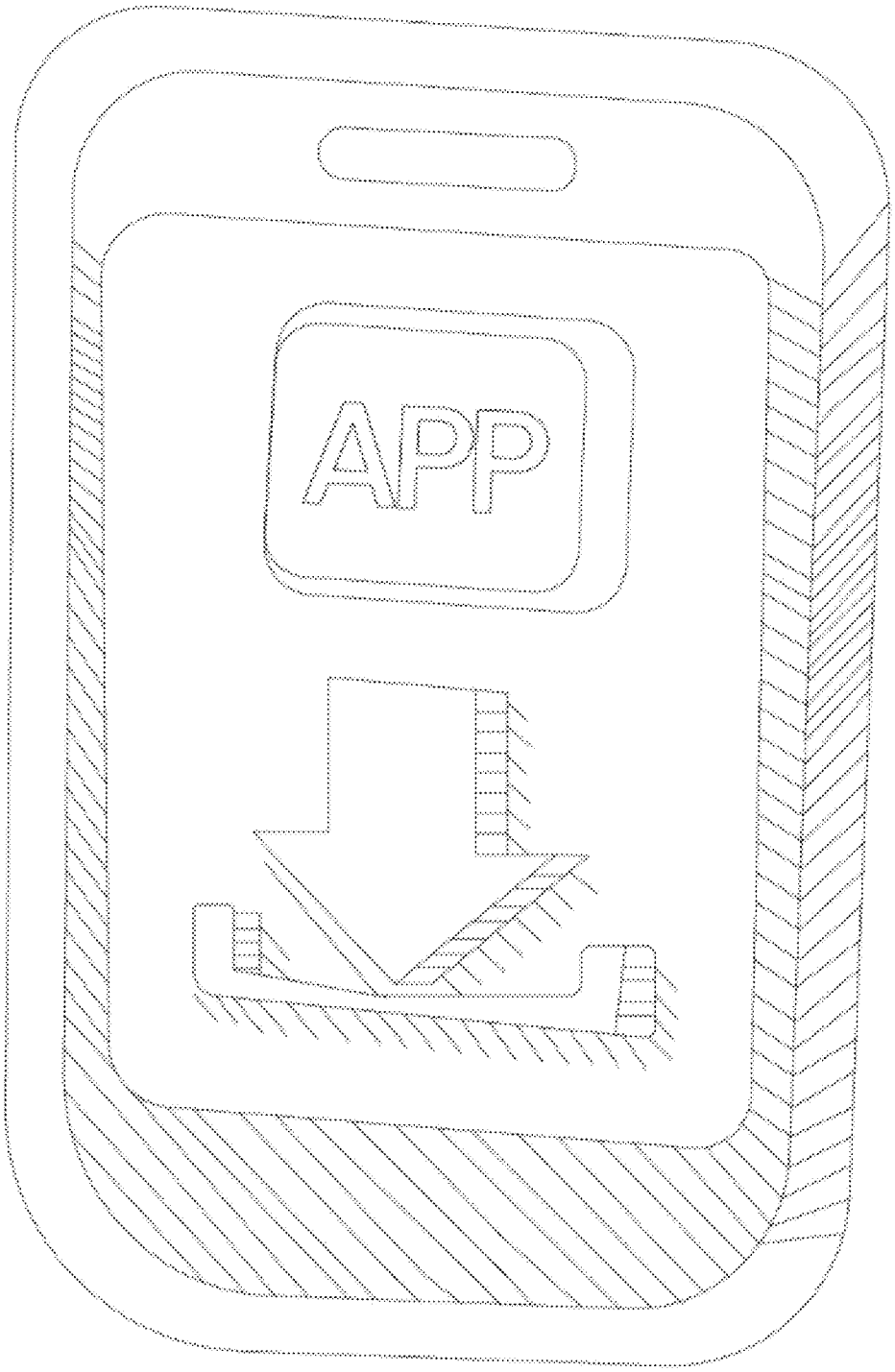
FIG. 4 shows a phone for running the app.
Figure 5:
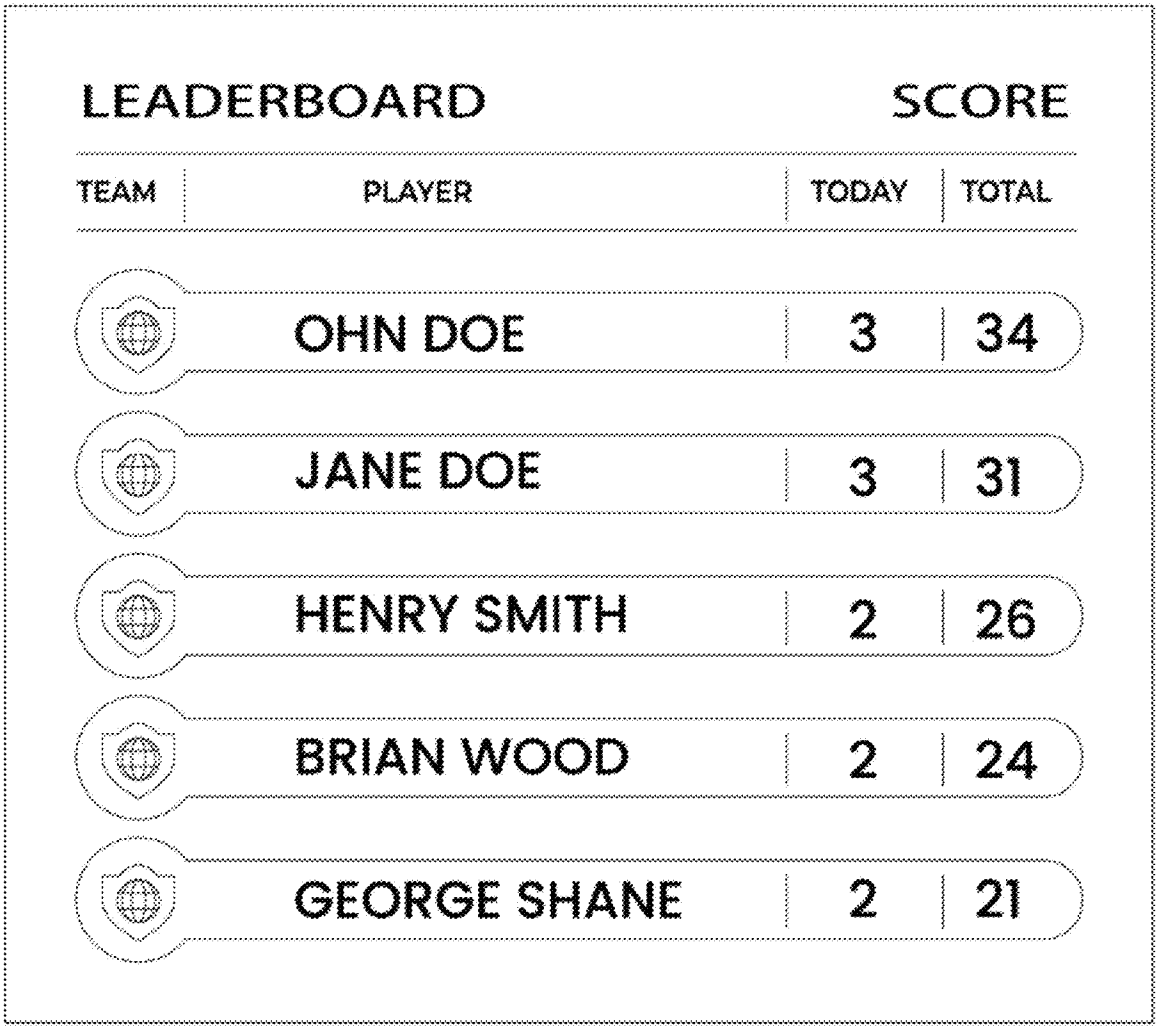
FIG. 5 shows an example of a GUI running on the app.
Figure 6:
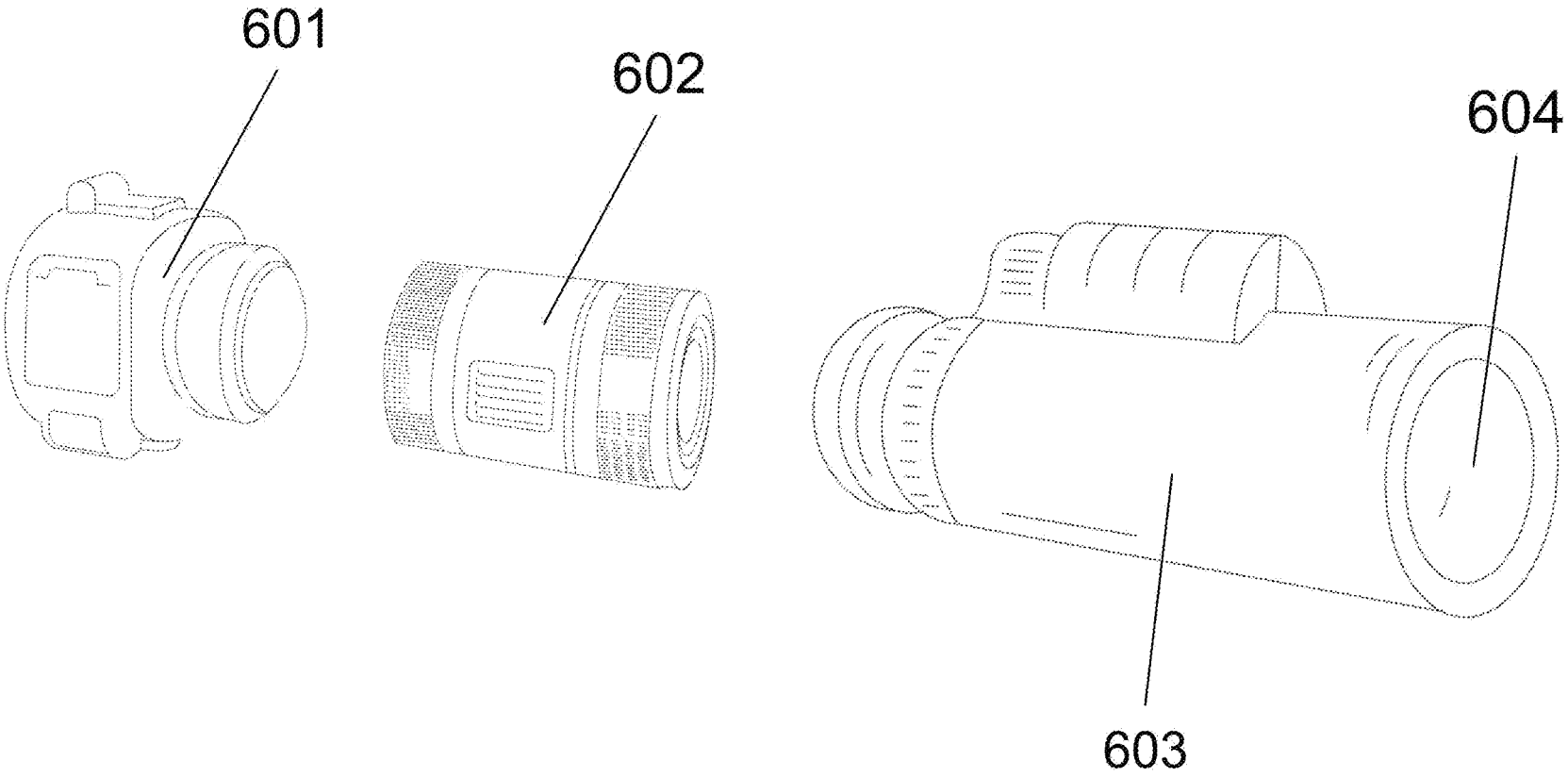
FIG. 6 shows an embodiment of the camera system.
Figure 8:
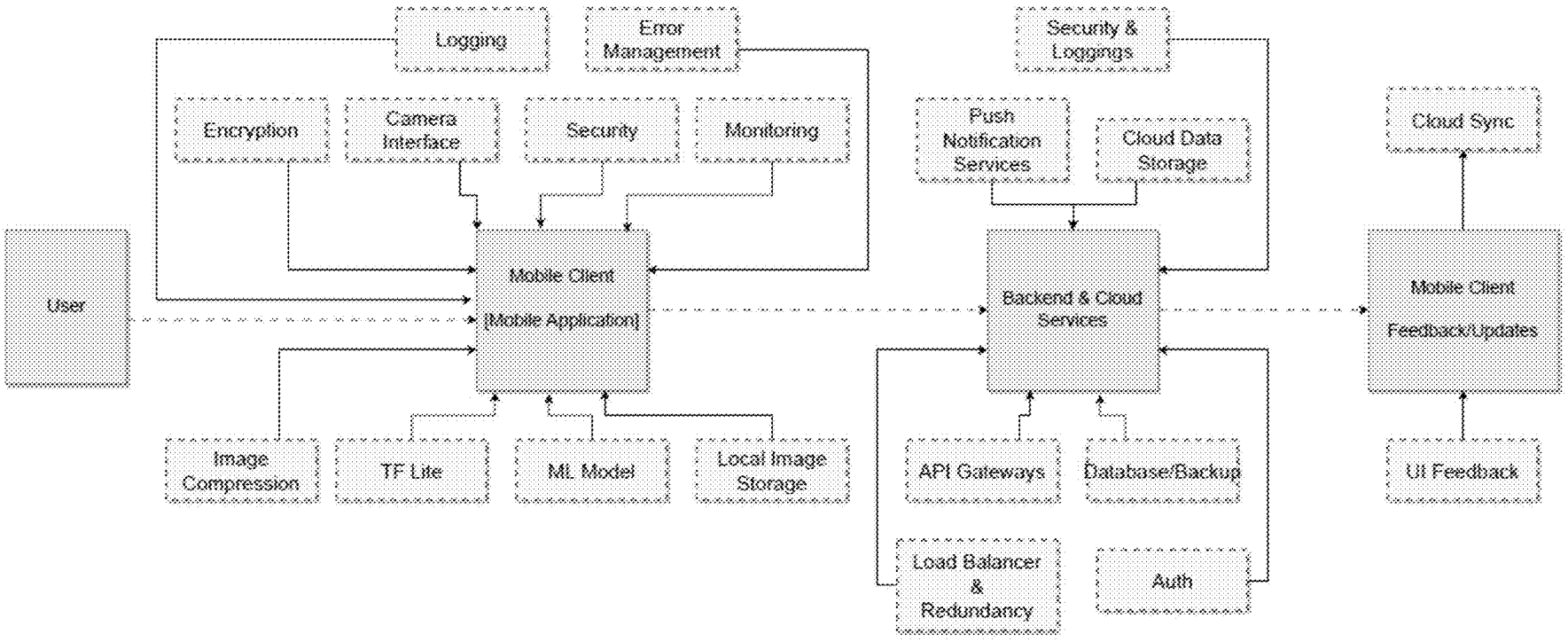
FIG. 8 shows an overview of the scoring system.
Figure 9:
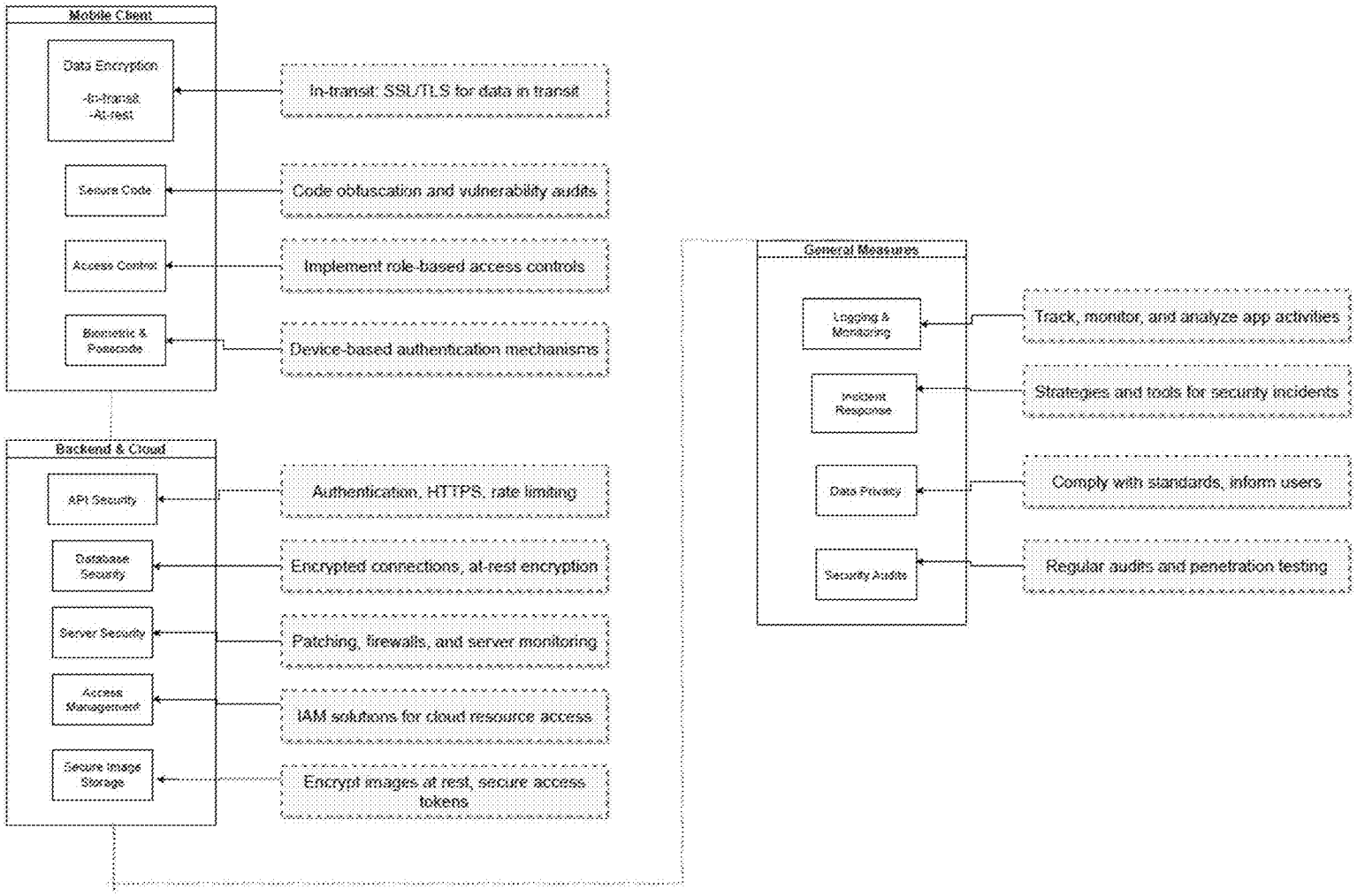
FIG. 9 shows a network overview of the scoring system.

FIG. 2 shows an overview of a shot tracking system for which the haptic device could be integrated into. The haptic device 102 is attached to the firearm 101 for detecting when the user pulls the trigger of the firearm 101. Information from the haptic device 102 is sent and received from the user's phone 206. The haptic information generated by the haptic device is sent to the phone to initiate a timing system to start a timer, which would indicate when the shot was fired and how long the bullet took to reach the target 205. The phone also receives and sends information to the camera device 201. The haptic information is also sent to the camera system directly from the haptic device or via the phone. The haptic information would trigger the camera system, which is aimed at the target, to start recording video or taking a series of still images that are relayed back to the phone. The phone uses an algorithm to analyze the video or still images to create an accuracy score that is displayed to the user on the phone. The information displayed to the user consists of, but is not limited to, image or where the bullet struck the target, an accuracy score based on a general scoring system or one that they have customized, and the timing information generated by the timing system. The information from the camera system would be used to determine when the bullet struck the target to determine the bullet travel time.

The shot tracking system uses all the information sent and received from/by the phone, haptic device, timing system, and the camera system to generate feedback for the user. This information could be aggregated by using AI or machine learning to learn the specifics of the user's shooting information and generate customized information to display to the user on the phone. The processing of the information could be performed locally on the phone or the phone could upload the information to a server to perform the processing, the information being sent from the server to the phone. The real-time feedback could be a numerical score using default scoring rules, customized rules inputted by the user, automatically generated by the phone, or any combination. The feedback could be sent to other user's phones that are using the same system to create a contest or leaderboard for all that are participating. Competitions such as accuracy, speed, recoil handling, or any combination of these could utilize the shot tracking system.

The camera system would include a lens 204, a scope 203, and a sensor 202. The sensor includes an eye piece that allows the user to aim the camera system at the target, but the camera system could also include an auto aiming feature where a motorized mount is used to hold the camera system, which would use image recognition to detect and focus and aim at the target. The camera system uses edge detection, contour tracing, and shape matching for detecting when a bullet strikes the target. The phone could display new bullet strikes with a particular shape or color to differentiate them from the previous bullet strikes on the target. The camera system would also be able to determine when there is not a bullet strike, which would be outputted to the phone in the form of a miss alert or how far off target the bullet was from the target.

The shot tracking system provides the user with the ability to share the information on social network accounts, overlay data over the images, and connect them to e-commerce sites to buy different firearms or accessories. The system could include a shooting coach feature that aggregates all the information from the various systems to provide the user with real time adjustments to make to their stance, how the user holds the firearm, aim, and any other information that would help the user improve their shooting. Multiple camera systems could be used to capture multiple images of the target, including but not limited to, different angles in all three dimensions, an angle that shows the user, an angle that shows the user and the back of the target, angles that show the target from the side, top or bottom. The shot tracking system could also use voice recognition software to allow for the user to control the system without taking their hand off of the firearm. The camera system could use any known and future type of image processing to enhance the images captured. The system could process the information locally or it could send and receive information from a cloud based system to reduce the processing requirements of the phone.

The haptic device detects the pulling of the trigger via the movement tracking of the user's hand and fingers to initiate the haptic feedback via the motors and/or actuators in the device. The haptic feedback could be as simple as a simple vibration or as complicated as simulating the recoil and motion of an actual firearm. The feedback could use the positioning data of the firearm to determine the position of the firearm in the user's hand and customize the feedback based on the position of the firearm. For example, if the user is handling the firearm incorrectly, the haptic feedback could make the firearm move in a manner that is different than a proper shot to indicate to the user that their grip needs to be corrected. The haptic feedback device could also be used to simulate different malfunctions of a firearm, including, but not limited to: misfires, jams, or other uncommon firearm malfunctions.

The haptic device uses micro haptic motors and/or linear resonant actuators for creating the simulated motion. The haptic motors rotate at a specific speed for a specific period of time to simulate the motion of the device. The actuator create motion by moving a mass connected to a spring back and forth to create a linear vibration or motion. The actuator would spring the mass at a specific force for a specific period of time. The motor(s) and/or actuator(s) could also be used to correct the user's grip, aim, stance, or other shooting technique by powering the motor/actuator to create a certain frequency. The frequency would increase, therefore increasing the vibrations, as the user's technique worsened and lesson the vibrations as the technique improved. The base amount of vibration could be zero, or it could be a very low vibration to indicate that the training is in progress.

The devices mentioned above could be implemented using any type of processor architecture able to execute software including, but not limited to, x86, ENIAC, RISC, Pentium™, and Apple Silicon™. The software could be any type of code that is used to instruct a processor to perform instructions including, but not limited to, Python™, Java™, C+™, FORTRAN, and Assembly. The software could be stored on any type of non-transitory medium including, but not limited to, RAM, ROM, Flash Memory, SD cards, solid stated drives, spinning platter storage devices, Punch Cards, Piano Player Reels, Hard Drives, and physical servers.

What is claimed is:

1. A firearm motion simulation device, comprising:

a firearm motion simulation device configured to be placed near or on a firearm being held by a user, for generating simulated recoil motion of the firearm that imitates recoil forces of a real firearm and that indicates to the user that they are handling the firearm in a proper or improper manner, the firearm motion simulation device comprising:

at least one motion detection sensor configured to detect motion of at least one of a hand of the user and the firearm in six degrees of freedom with sub-millimeter motion tracking at a sampling interval of about 50 milliseconds, and a processor configured, in response to the motion detection sensor detecting the motion of the hand or the firearm, to apply an algorithm to determine feedback that the user needs to make and then translate the feedback into a motion that is generated by the firearm motion simulation device using at least one haptic motor or linear resonant actuator to simulate a recoil motion profile that is selected based on the detected motion and that corresponds to at least one of a specific firearm type or a specific user handling condition, wherein the motion generated by the firearm motion simulation device is output as:

(i) a simulated recoil motion that is triggered when the motion detection sensor detects a trigger pull event, and (ii) a corrective motion pattern having a vibration frequency, duration, or direction that encodes a particular shooting correction selected from at least grip correction and aim correction, and wherein the corrective motion pattern is lessened when the user corrects their handling of the firearm, and increased when the user does not correct their handling of the firearm.

2. The firearm motion simulation device of claim 1, further comprising an inertial measurement unit (IMU) and a depth mapping unit both containing sensors for tracking the firearm and user in three dimensions to generate a three-dimensional map of an environment surrounding the firearm, the three-dimensional map being updated in real-time based on infrared depth measurements.

3. The firearm motion simulation device of claim 2, wherein the IMU and depth mapping unit perform the tracking in real time continuously during a training session with an update interval of about every 50 milliseconds, to detect motion too subtle to be noticed by a human observer.

4. The firearm motion simulation device of claim 3, wherein the IMU comprises at least two of an accelerometer, gyroscope, and magnetometer to measure the movement of the user and the firearm.

5. The firearm motion simulation device of claim 2, wherein the IMU tracks motion using a 6 to 9-axis sensor that provides sub-millimeter motion tracking for at least each sample obtained at about every 50 milliseconds during a training exercise.

6. The firearm motion simulation device of claim 3, wherein the depth mapping unit uses infrared to measure the movement of the user and the firearm.

7. The firearm motion simulation device of claim 6, the depth mapping unit uses Time of Flight (ToF) or LIDAR sensors.

8. The firearm motion simulation device of claim 1, wherein the motion simulation device uses a microprocessor running an optimized algorithm to analyze data from the sensors in real time and to process at least 50 data points per feedback instance for outputting the simulated recoil motion and the corrective motion pattern in real time to the user.

9. The firearm motion simulation device of claim 8, wherein the haptic feedback module's vibration motors are configured to modulate frequency, duration, and pulsing based on input from the IMU and infrared sensors to vary the simulated recoil motion profile and the corrective motion pattern independently.

10. The firearm motion simulation device of claim 1, wherein the sensors and haptic feedback are adjustable by the user or the device without intervention from the user to customize simulated recoil motion and the corrective motion pattern for specific firearms, training scenarios, or individual shooters.

11. The firearm motion simulation device of claim 1, wherein the device can enter an automated idle mode to allow for cooling of a barrel of the firearm and to reduce power consumption of the motion detection sensor, the IMU, the depth mapping unit, and the at least one haptic motor or linear resonant actuator when no trigger pull or motion exceeding a threshold is detected for a predetermined time interval.

12. The firearm motion simulation device of claim 1, wherein the motion generated is created using motors or actuators.

13. The firearm motion simulation device of claim 12, wherein the device uses the data collected by the motion sensors in real-time to adapt the haptic feedback using different frequency, duration or pulsing of the motors or actuators, wherein a first vibration pattern is associated with correcting a grip of the user, and a second vibration pattern different from the first vibration pattern is associated with correcting an aim of the user, and wherein a baseline vibration of zero indicates that the user is performing within an acceptable range.

14. The firearm motion simulation device of claim 1, wherein the device outputs graphical information provided to a users mobile device for further instructing the user.

15. The firearm motion simulation device of claim 14, wherein the device outputs the information to the mobile device via a secure wireless connection between the device and the mobile device.

16. The firearm motion simulation device of claim 1, wherein the sensor data can be adjusted to compensate for rapid fire situations.

17. The firearm motion simulation device of claim 1, wherein the device operation can be customized for each user or training situation.

18. The firearm motion simulation device of claim 1, wherein the device is designed to not impede the users actions during use.

19. The firearm motion simulation device of claim 1, wherein the device uses an energy efficient mode for prolonging use time by reducing a power level of at least the motion detection sensor and the haptic motors during the automated idle mode of claim 11.

20. The firearm motion simulation device of claim 1, wherein the device is designed to withstand environmental conditions including at least two of weather, dust, impact, and quick movements.

* * * * *